US009765463B2

(12) United States Patent
Ashrafzadeh et al.

(10) Patent No.: US 9,765,463 B2
(45) Date of Patent: Sep. 19, 2017

(54) LAUNDRY TREATING APPLIANCE WITH TUMBLE PATTERN CONTROL

(71) Applicant: Whirlpool Corporation, Benton Harbor, MI (US)

(72) Inventors: Farhad Ashrafzadeh, Bowling Green, KY (US); Ryan R. Bellinger, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 803 days.

(21) Appl. No.: 14/153,414

(22) Filed: Jan. 13, 2014

(65) Prior Publication Data

US 2014/0123514 A1 May 8, 2014

Related U.S. Application Data

(62) Division of application No. 12/538,473, filed on Aug. 10, 2009, now Pat. No. 8,631,527.

(51) Int. Cl.

| | |
|---|---|
| ***D06F 33/02*** | (2006.01) |
| ***D06F 39/00*** | (2006.01) |
| ***D06F 58/04*** | (2006.01) |
| ***D06F 58/28*** | (2006.01) |

(52) U.S. Cl.

CPC ..... *D06F 33/02* (2013.01); *D06F 39/003* (2013.01); *D06F 39/005* (2013.01); *D06F 58/04* (2013.01); *D06F 58/28* (2013.01); *D06F 2058/2861* (2013.01); *D06F 2202/065* (2013.01); *D06F 2202/10* (2013.01); *D06F 2204/065* (2013.01)

(58) Field of Classification Search

CPC ..... D06F 39/003; D06F 33/02; D06F 2058/2861; D06F 2202/065; D06F 2204/065

USPC ..... 8/137, 159; 68/139

See application file for complete search history.

(56) References Cited

U.S. PATENT DOCUMENTS

| | | | | |
|---|---|---|---|---|
| 5,293,760 A * | 3/1994 | Tani | D06F 39/003 | 68/12.02 |
| 5,339,474 A * | 8/1994 | Kim | D06F 39/003 | 68/12.02 |
| 2008/0109967 A1* | 5/2008 | Ashrafzadeh | D06F 13/02 | 8/159 |
| 2008/0120789 A1* | 5/2008 | Ashrafzadeh | D06F 39/003 | 8/159 |

FOREIGN PATENT DOCUMENTS

JP H05200194 * 8/1993

OTHER PUBLICATIONS

JPH05200194—Machine Translation, Aug. 1993.*

* cited by examiner

*Primary Examiner* — Michael Kornakov
*Assistant Examiner* — Marc Lorenzi

(57) ABSTRACT

An apparatus and a method of operating a laundry treating appliance treating laundry according to a cycle of operation having by determining a parameter indicative of a change in packing density of the laundry in a treating chamber and taking an operating action based on the determined parameter.

8 Claims, 7 Drawing Sheets

LAUNDRY TREATING APPLIANCE WITH TUMBLE PATTERN CONTROL

CROSS-REFERENCE TO RELATED APPLICATIONS

The present application represents a divisional application of U.S. patent application Ser. No. 12/538,473 entitled "LAUNDRY TREATING APPLIANCE WITH TUMBLE PATTERN CONTROL" filed Aug. 10, 2009, now U.S. Pat. No. 8,631,527, issued Jan. 21, 2014.

BACKGROUND OF THE INVENTION

Contemporary laundry treating appliances have a number of pre-programmed cycles of operation. The cycles of operation may be selected by the appliance based on user's settings or may be manually set by a user. Once the cycle is selected, a controller for the laundry treating appliance controls the actuation of the various components to implement the cycle of operation. For those treating appliances having a rotating drum defining a treating chamber, the controller actuates a motor to rotate the drum at one or more predetermined set speeds in accordance with the needs of the different phases of the cycle of operation.

In most treating appliances process parameters for an operation process of a laundry treating appliance may be set based on the laundry load size. In some laundry treating appliances, the user manually inputs a qualitative laundry load size (extra-small, small, medium, large, extra-large, etc.), in other treating appliances, the treating appliance automatically determines the laundry load size.

Historically, contemporary appliances do not take into account the distribution of the laundry load within a rotating drum of the appliance. That distribution may change during the cycle of operation influencing the effectiveness of a particular phase of the cycle or even an overall performance of treating appliance.

SUMMARY OF THE INVENTION

An apparatus and a method of operating a laundry treating appliance treating laundry according to a cycle of operation by determining a parameter indicative of a change in packing density of the laundry in a treating chamber and taking an operating action based on the determined parameter.

DESCRIPTION OF EMBODIMENTS OF THE INVENTION

Figure 1:
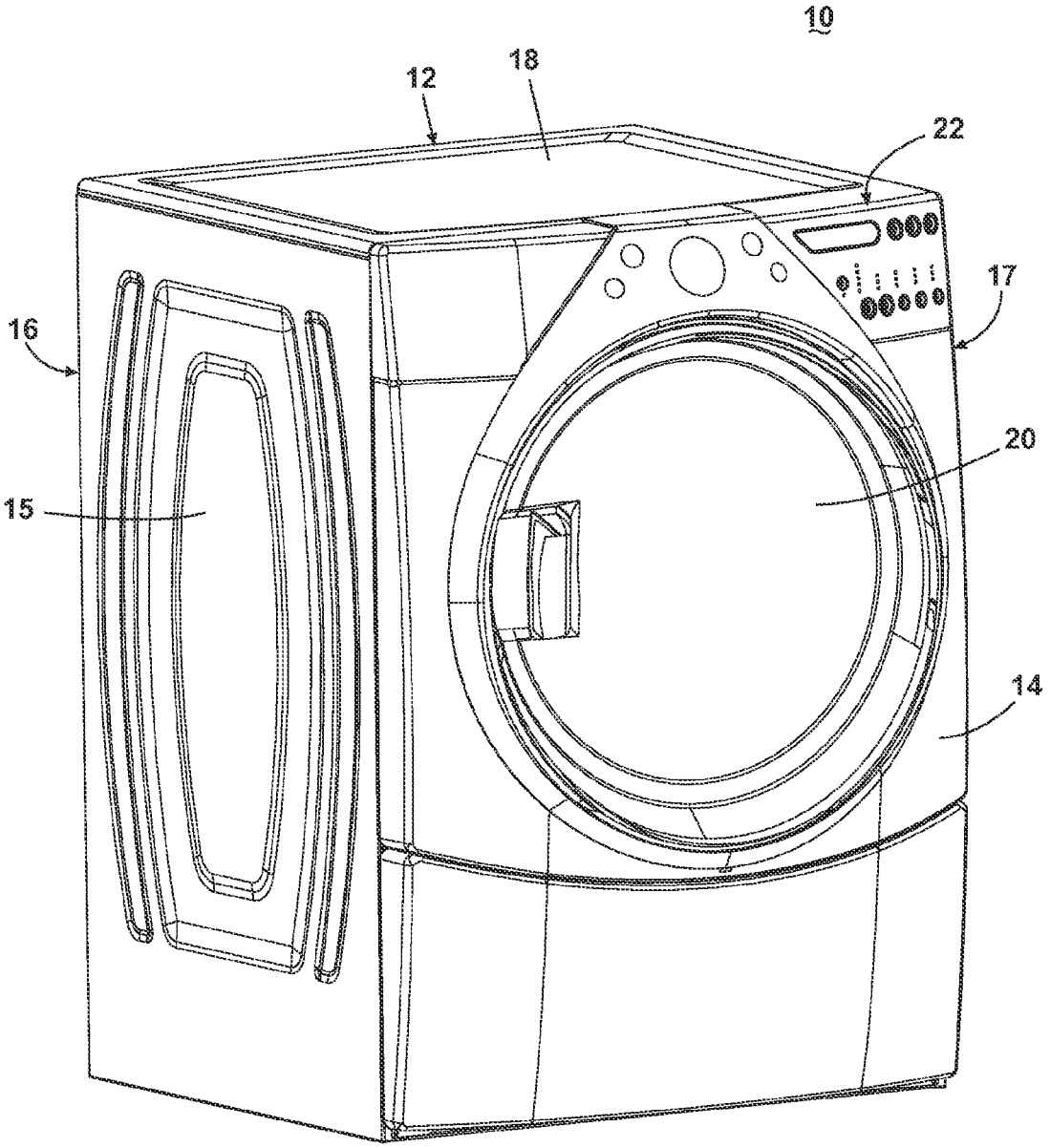
FIG. 1 is a perspective view of an exemplary laundry treating appliance in the form of a clothes dryer according to the first embodiment.

Referring now to the figures, FIG. 1 is a perspective view of an exemplary laundry treating appliance in the form of a clothes dryer 10 according to a first embodiment. The clothes dryer 10 of the illustrated embodiment may include a cabinet 12 defined by a front wall 14, a rear wall 16, and a pair of side walls 15 and 17 supporting a top wall 18. A door 20 may be hingedly mounted to the front wall 14 and may be selectively moveable between opened and closed positions to close an opening in the front wall 14, which provides access to the interior of the cabinet. A control panel or user interface 22 (FIG. 1) may include one or more knobs, switches, displays, and the like for communicating with the user, such as to receive input and provide output.

The clothes dryer 10 is described and shown for illustrative purposes and is not intended to be limiting. The methods described herein may be used with any suitable laundry treating appliance and are not limited to use with clothes dryers. The laundry treating appliance may be any machine that treats fabrics, and examples of the laundry treating appliance may include, but are not limited to, a washing machine, including top-loading, front-loading, vertical axis, and horizontal axis washing machines; a dryer, such as a tumble dryer or a stationary dryer, including top-loading dryers and front-loading dryers; a combination washing machine and dryer; a tumbling or stationary refreshing/revitalizing machine; an extractor; a non-aqueous washing apparatus; and a revitalizing machine. For illustrative purposes, the laundry treating appliance and a method will be described with respect to a clothes dryer with the fabric being a laundry load, with it being understood that the invention may be adapted for use with other types of laundry treating appliance for treating fabric. Examples of laundry include, but are not limited to, a hat, a scarf, a glove, a sweater, a blouse, a shirt, a pair of shorts, a dress, a sock, a pair of pants, a shoe, an undergarment, and a jacket. Furthermore, textile fabrics in other products, such as draperies, sheets, towels, pillows, and stuffed fabric articles (e.g., toys), may be dried in the clothes dryer 10.

Figure 2:
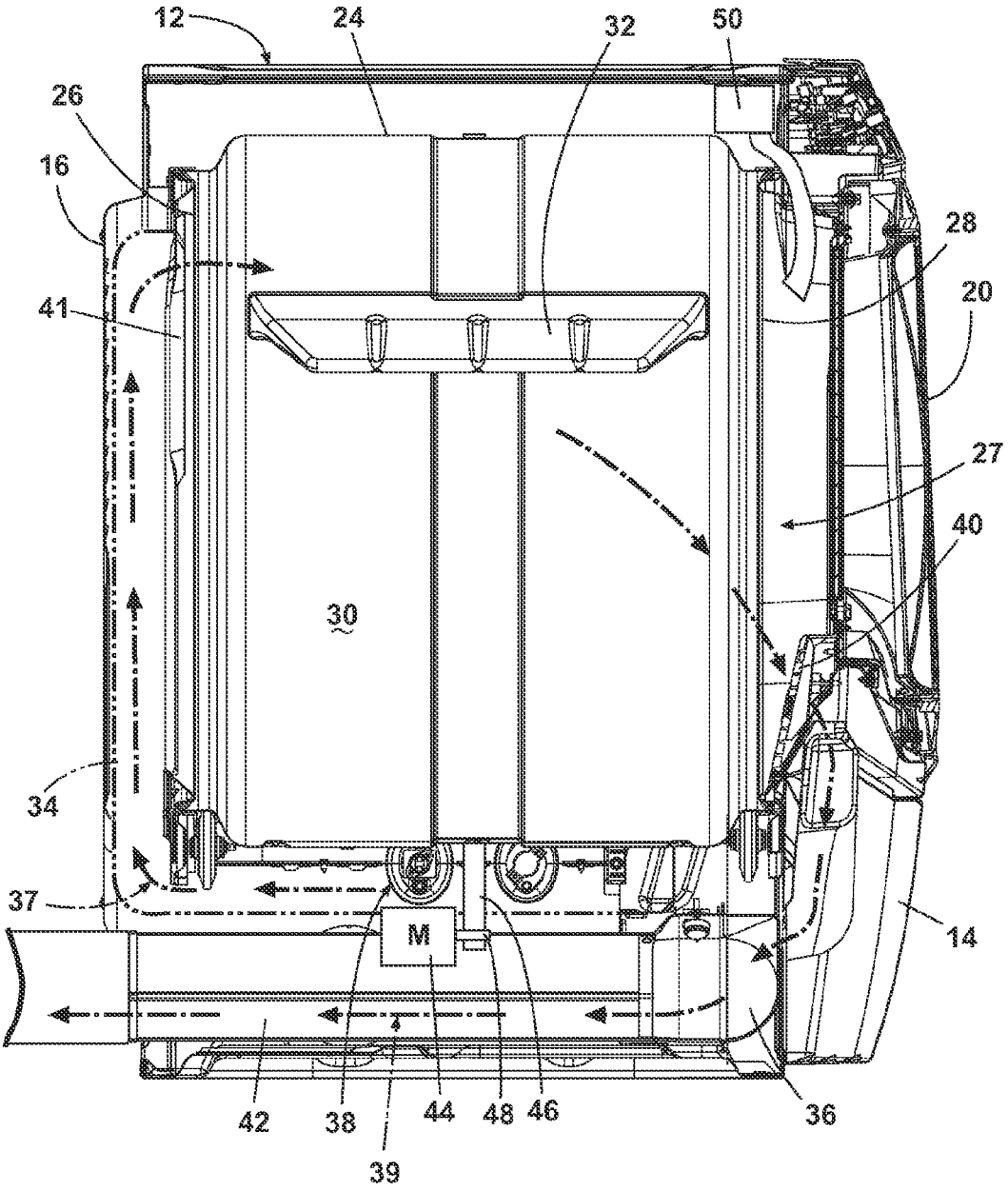
FIG. 2 is a schematic cross sectional view of the dryer of FIG. 1 according to the first embodiment.

FIG. 2 provides a schematic cross sectional view of the fabric treatment appliance of FIG. 1. A rotatable drum 24 may be disposed within the interior of the cabinet 12 between opposing stationary rear and front bulkheads 26 and 28, which collectively define a drying chamber 30, for drying laundry. Alternatively, the drum 24 and bulkheads configuration may be of a different type, some non-limiting examples are: a closed end drum (for example, closed rear end), a non-stationary rear bulkhead or a non-stationary inlet grill type.

The front bulkhead 28 may have an opening 27 that aligns with the open face of the front wall 14. The drum 24 may have a circumference larger than that of the door 20 such that part of the front bulkhead 26 covers a portion of the front face of the drum 24. Thus, when the door 20 may be in a closed position, it closes the face of the cabinet 12 and not the entire face of the drum 24. However, the drum 24 may be considered to be closed when the door 20 is in the closed position.

The drum 24 may further optionally have one or more lifter or baffles 32. In most dryers, there are multiple baffles.

The baffles 32 may be located along the inner surface of the drum 24 defining an interior circumference of the drum 24 and may be oriented generally parallel to a rotational axis of the drum 24. The baffles 32 facilitate the tumbling action of the fabric load within the drum 24 as the drum 24 rotates about the rotational axis. Alternatively, a textured surface may be used in place of or in addition to the baffles 32.

An air flow system 34 may be of any conventional type and is provided to draw air into and exhaust air from the treating chamber 30. As illustrated, the air flow system has inlet duct 37 coupled to the treating chamber by an inlet 41 in the rear bulkhead 26 and an outlet duct 39 coupled to the treating chamber by a lint filter 40. A blower 36 is provided to first draw air through the inlet duct, into the heating chamber, and exhausting air from the heating chamber through the outlet duct. A heating system 38 may be provided within the inlet duct to heat the air as it passes through on the way to the treating chamber.

A motor 44 may be coupled to the drum 24 through a belt 46 (or any other means for indirect drive such as a gearbox) and a drive shaft 48 may rotate the drum 24. Some non-limiting examples of indirect drive are: three-phase induction motor drives, various types of single phase induction motors such as a permanent split capacitor (PSC), a shaded pole and a split-phase motor. Alternately, the motor 44 may be a direct drive motor, as is known in the art. Some non-limiting examples of an applicable direct drive motor are: a brushless permanent magnet (BPM or BLDC) motor, an induction motor, etc.

The clothes dryer 10 may further have an optional chemistry dispersing system 50 to enable a special laundry treatment such as, for example, refreshment or disinfection. The chemistry dispersing system 50 may introduce chemistry into the drum 24 in any suitable manner, such as by spraying, dripping, or providing a steady flow of the chemistry. The chemistry dispersing may be applied to only part of the laundry or to the substantially entire load of the drum 24. The chemistry may be in a form of gas, liquid, solid or any combination thereof and may have any chemical composition enabling improved wrinkle, odor, softness, whitening, brightening, addition of fragrance, or any other desired treatment of the laundry. Water is one example of a suitable chemistry composition.

Figure 3:
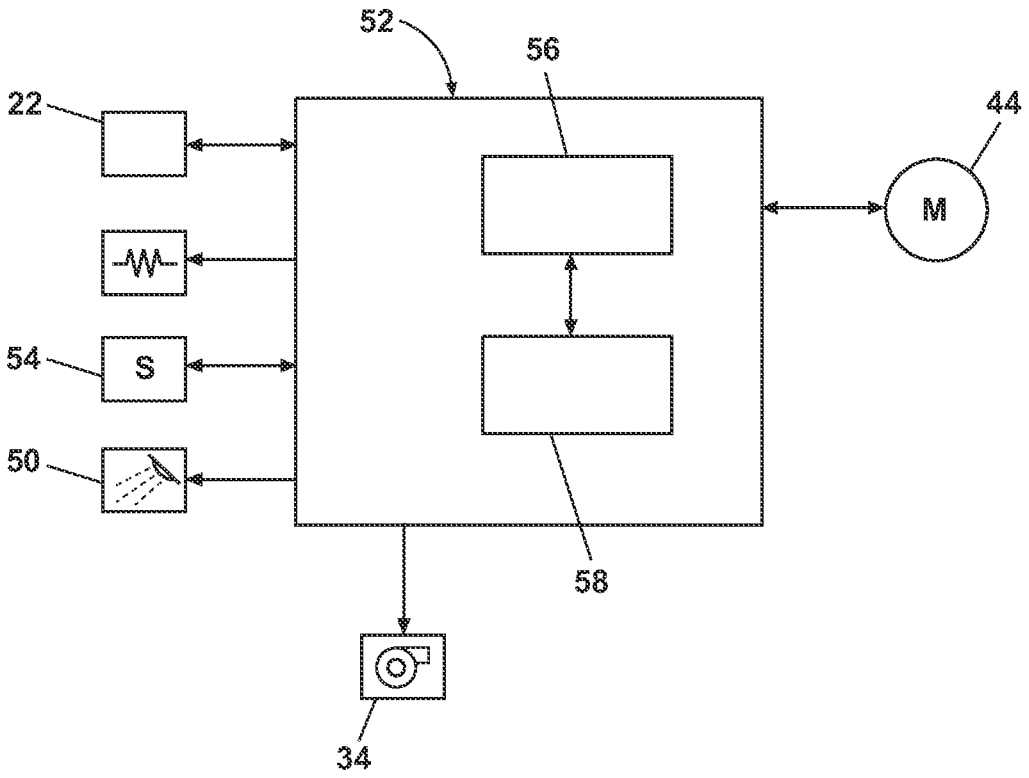
FIG. 3 is a schematic view of a control system according to a second embodiment for the dryer of FIGS. 1 and 2.

Referring now to FIG. 3, which is a schematic view of an exemplary control system of the clothes dryer 10. Many known types of controllers may be used for the controller 52. The specific type of controller is not germane to the invention and can have any hardware or software architectures and partitioning. The controller 52 may be a combination of a main machine controller 56 and a motor controller 58 within one physical location or a practical implementation may require their physical separation. The motor controller 58 may be configured to control the motor 44 and physically located on the motor 44 and electrically coupled to the main machine controller 56. The main machine controller 56 may be configured to control other working components of the clothes dryer 10, such as, for example, the motor 44, the user interface 22, the air flow system 34, a chemistry dispersing system 50 and one or more sensor 54, such as, for example, a temperature sensor. It is contemplated that the controller 70 is a microprocessor-based controller that implements control software stored in memory internal to or in communication with the microprocessor, which may comprise one or more software applications, and sends/receives one or more electrical signals to/from each of the various working components to affect the control software. Examples of possible controllers are: proportional control (P), proportional integral control (PI), and proportional derivative control (PD), or a combination thereof, a proportional integral derivative control (PID control), may be used to control the various components.

Furthermore, with a suitable control system the motor 44 can not only be used in an actuation mode, i.e. rotating the laundry load, but may also be used as a sensor. For relatively little or no extra cost, information like the torque and/or speed of the motor 44 may be monitored and utilized. Thus, a suitable control system may be any system in which the motor torque and/or speed may be directly sensed or estimated by a suitable system parameter indicative of motor torque and/or speed. The parameter indicative of the motor torque may be motor voltage, current, power or any combination thereof. The information received from the motor, may be analyzed in time and frequency domains, as will be described in more details below.

The motor 44 controlled by the controller 52, may rotate the drum 24 at various speeds in opposite rotational directions. In particular, the motor 44 may rotate the drum 24 at tumbling speeds wherein the fabric items move with the drum 24 from a lower location of the drum 24 towards a higher location of the drum 24, but fall back to the lowest location of the drum 24 before reaching the highest location of the drum 24. This lifting/falling movement between the lower and higher locations by the individual items of the laundry load is accomplished by the rotation of the drum 24 and is enhanced by the baffles 32. During tumbling, the individual fabric items in the laundry load may move relative to one another such that the fabric items may rub against each other and may fall onto each other (impact force) as they fall to the lowest location of the drum 24. Typically, the radial force applied to the fabric items at the tumbling speeds may be less than about 1 G.

The motor 44 may further rotate the drum 24 at rolling speeds wherein the individual items forming the laundry load collectively form a ball-shaped mass that rotates with the drum 24. While there may be some lifting/falling movement of the individual items, the primary movement of the laundry is the collective rolling of the ball-shaped mass, which rolls or rotates as a single body while the drum 24 rotates, rather than moving as individual fabric items. As used herein, "rolling speed" refers to a rotational rate of the drum 24 needed to cause the laundry to rotate in a ball-shaped mass. Typically, the radial force applied to the fabric items at the rolling speeds may be less than about 1 G, and the rolling speeds may be slower than the tumbling speeds.

Alternatively, the motor 44 may rotate the drum 24 at spin speeds wherein the fabric items rotate with the drum 24 without lifting/falling. In the laundry treating art, the spin speeds may also be referred to as satellizing speeds or sticking speeds because the laundry sees a centrifugal force greater than or equal to 1 G causing the laundry to stick or plaster against the drum. As used herein, "tumbling" of the drum 24 refers to rotating the drum 24 at a tumble speed where the items of the laundry lift/fall, "rolling" of the drum 24 refers to rotating the drum 24 at a rolling speed where the laundry primarily rolls as a single collective mass, "spinning" of the drum 24 refers to rotating the drum 24 at a spin speed where the laundry is plastered against the drum, and "rotating" of the drum 24 refers to rotating the drum 24 at any speed.

The clothes dryer 10 may perform one or more manual or automatic operation cycles with at least one treating cycle of operation. The operation cycle may include several phases of the cycle; some non-limiting examples of those phases are: a drying process, an untwisting or untangling cycle, a chemistry dispensing phase, some operation cycles may have only one or any combination of these exemplary phases or sub-cycles. Regardless of the processes employed in the operation cycle, the methods described below for determining a size and a packing density of the load will improve performance of the cycle of operation.

Before specific embodiments of the methods according to the invention are presented, a description of theory behind the methods may be constructive to a complete understanding.

Figure 4:
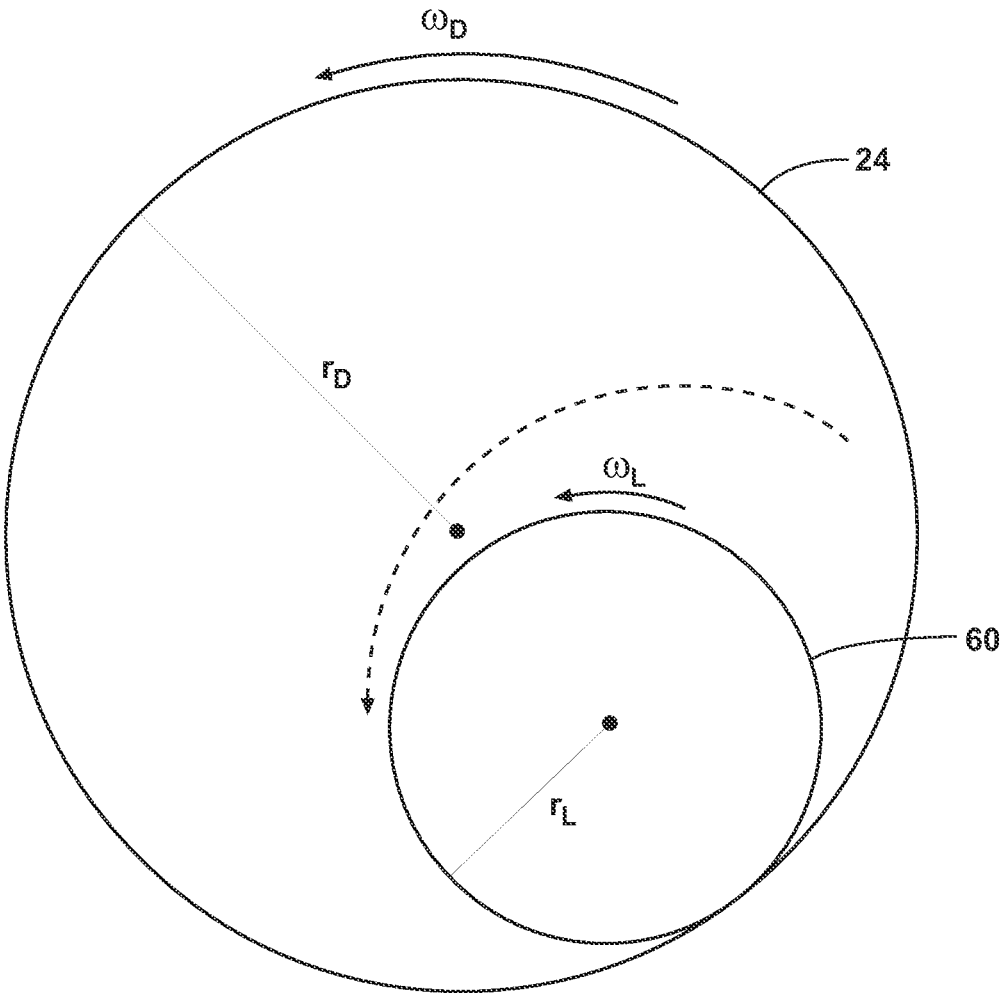
FIG. 4 is a schematic view of a drum and a laundry load distribution in the drum of the dryer of FIGS. 1 and 2.

Referring now to FIG. 4, which is a schematic view of the drum 24 and a laundry load 60 distribution in the drum 24 indicative of a rolling movement of the laundry load, the methods of the present invention may depend on a rotational speed of the laundry load 60 (indicated by $\omega_L$) resulting from rotation of the drum 24. The drum 24 may be rotated at a rolling speed (indicated by $\omega_D$) such that, as described above, the laundry load 60 forms a unitary mass that generally rotates with the drum 24 along with some minor lifting/falling of the collective mass as shown by the phantom lines. While the laundry load 60 is illustrated in FIG. 4 as a circle, the laundry load 60 in reality need not assume such a shape; the actual shape of the laundry load 60 may depend on the size of the laundry load 60 and the types of fabric items in the laundry load 60. The actual shape is more in the form of a blob that folds over on itself.

The load may be characterized in terms of its packing density, which may be defined as an indication of the free space inside of the drum 24. Thus, packing density may be defined as the ratio of the volume of the laundry load to the total volume of the treating chamber. Alternatively, it may be defined as the free volume of the treating chamber to the total volume of the treating chamber. The packing density may be simplified by looking at the two-dimensional projection, such as is illustrated in FIG. 4, where the area of the load 60 is compared to the area of the drum 24, such as by a ratio between the two areas.

The magnitude of or change in the packing density may be used as an indicator of a condition or characteristic of the laundry load. For example, as the individual items become tangled, the load size will tend to decrease. Thus, a decrease in the packing density (ratio of load area to drum area) over time may be an indicator of tangling. Each load 60 distribution may have a different packing density, making the packing density a dynamic parameter which reflects tumbling or tangling of the laundry load 60 during a cycle of operation. Untwisting or untangling of the load 60 may be performed once during the cycle of operation or repeated as needed and may be accomplished by changing the speed of the drum 24, by changing the direction of rotation, making the tumbling pattern unsymmetrical from clockwise to counterclockwise rotational directions, or by combination thereof. For example, the drum 24 may be rotated in the opposite direct that caused the twisting or tangling until the packing density returns to a pre-twisting/tangling state.

Also, the packing density affects how the load 60 moves and can therefore affect the mechanical action inflicted on the load 60. If the amount of free space in the drum 24 is high, then the load 60 has the freedom to move and can interact with the rest of the load as well as with the drum 24 and baffles 32. As the amount of free space decreases, the load 60 has less and less freedom to move and therefore, less mechanical action. A determination of the packing density according to the present invention may be used for estimation of mechanical action and for a variety of adaptive cycles. Additionally, determination of the packing density according to the present invention may be used for delivering fabric care with less fabric damage, which in terms provides a greater user satisfaction.

Packing density can also be used to determine the state of cloth fluffing during drying process. Cloth fluffing is a state of drying process in which the clothes surface moisture is evaporated while the internal moisture still remains. At this state, the clothes "fluffs" or "floats" within drum during the tumbling action much more as comparing to a wet load. This fluffing decreases amount of free space within the drum 24, leading to a change in packing density.

At the state of cloth fluffing, if no precautions are taken, the temperature within the drying chamber will begin to exponentially raise leading to the fabric damage. Conventional dryers do not have a way to determine when the state of cloth fluffing occurs, and thus, have a safe setting of changing the drying settings way in advance to the time of state of cloth fluffing occurrence, which in terms, means longer and less efficient drying cycle.

Determining the state of cloth fluffing according to the present invention may be used to enable a variety of adaptive cycles having adaptive drying settings (for example, drying temperature), a better estimated end of cycle, energy savings and delivering fabric care with less fabric damage.

One exemplary approach using the motor 44 as a sensor may be to convert the motor torque signal from time domain to frequency domain in order to determine one or more parameter useful for packing density estimation.

Figure 5A:
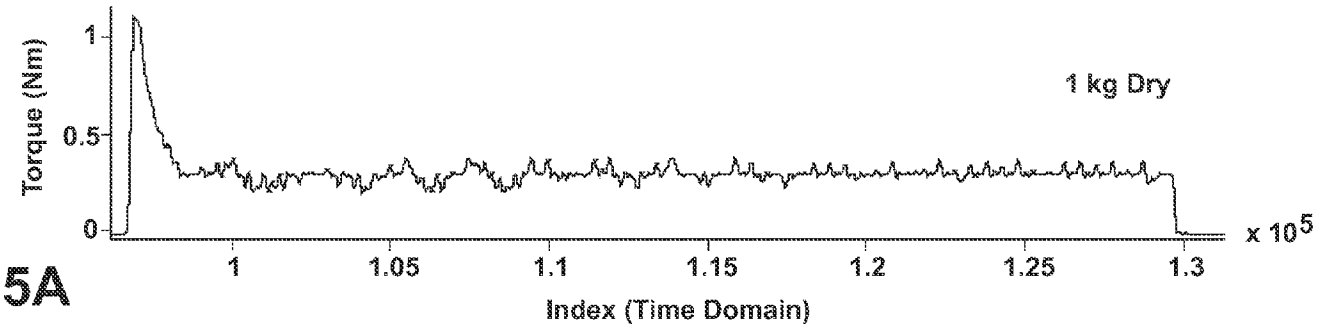
FIGS. 5A-5C are graphs of motor torque from a motor that drives the drum of the dryer of FIG. 1, wherein the motor torque is shown in a time domain for laundry loads having a dry mass of about 1, 3, and 5 kg.
Figure 5B:
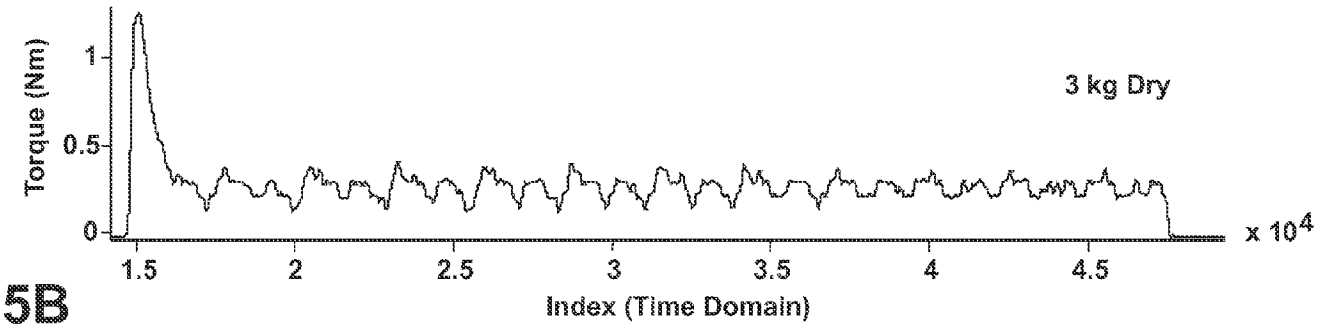
Figure 5C:
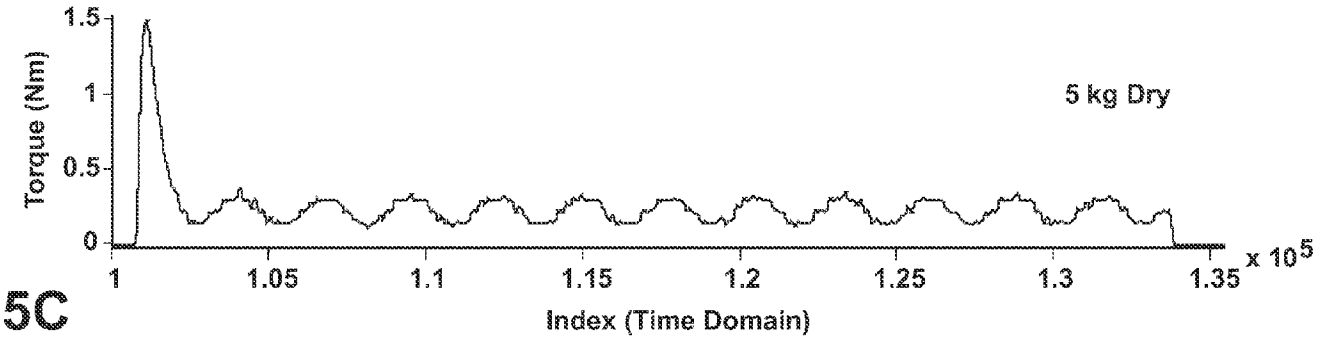

FIGS. 5A-5C show exemplary experimental data of the motor torque as a function of time (i.e., in the time domain) for 1, 3, and 5 kg dry mass polyester laundry loads, respectively. In the graphs, the time axis (i.e., the x-axis) is provided as an "Index" rather than "Time" due to the manner of recording experimental data. No clear periodic or useful content related to motion of the laundry load in the drum 24 can readily be seen in the time domain. In contrast, it has been discovered that the motor torque data in the frequency domain indeed contains useful information, as will be described in detail below. Thus, the parameter representative of the rotational speed of the laundry may be obtained from the motor torque data in the frequency domain.

Figures 6A, 6B, 6C:
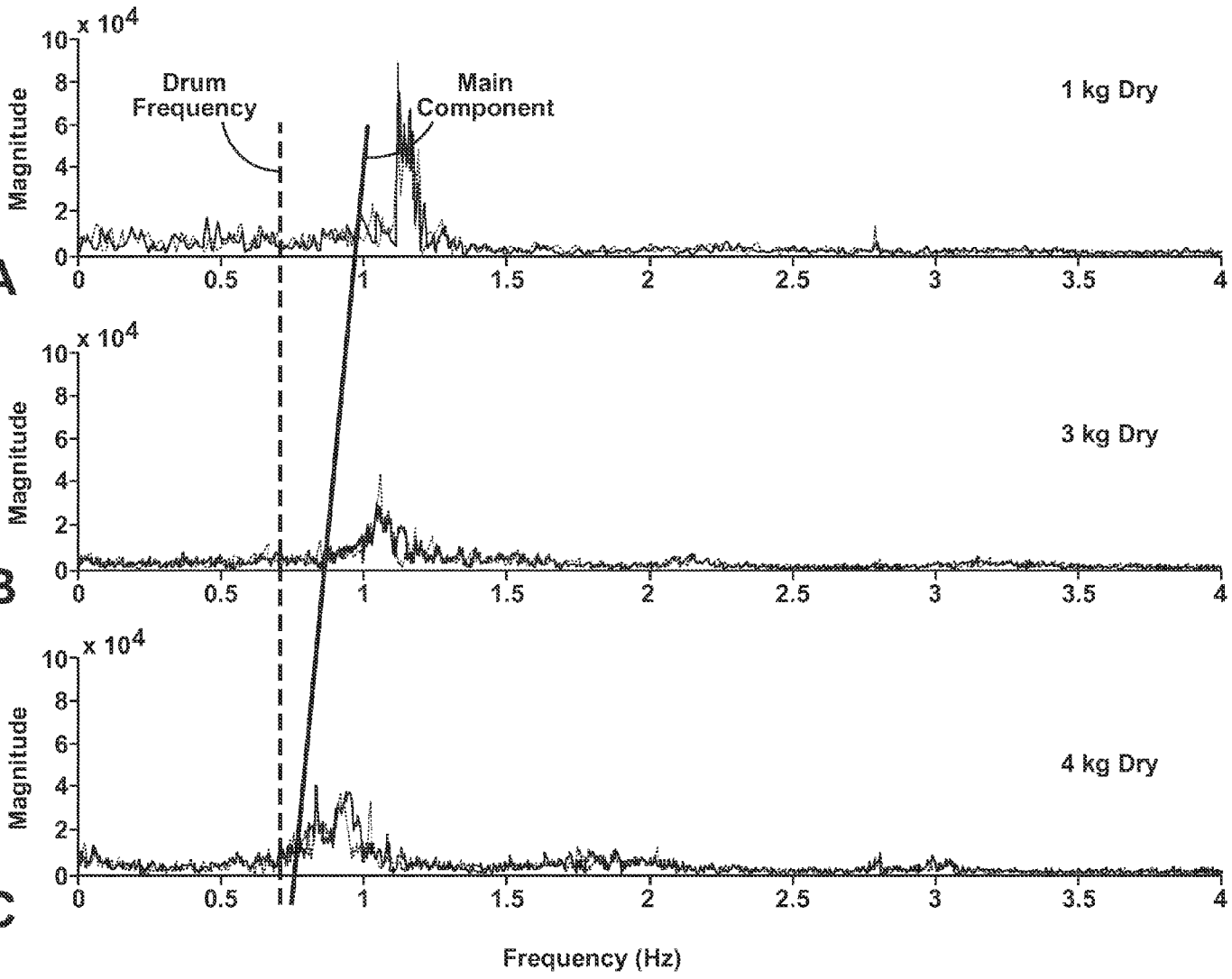
FIGS. 6A-6C are graphs of motor torque from a motor that drives the drum from the dryer of FIG. 1, wherein the motor torque is shown in a frequency domain for laundry loads having a dry mass of about 1, 3, and 4 kg.

FIGS. 6A-6C provide exemplary graphs of a Fast Fourier Transform of the steady state motor torque data as a function of frequency for respectively 1, 3, and 4 kg dry mass laundry loads. Each graph includes two sets of experimental data to show reproducibility of the method. As it can be seen, rotation of the load 60 shows up as the main component (a wide peak) and is shifted from the drum frequency depending on the load size. This main component may be used for the estimation of the packing density, as will be described below in further details.

In one embodiment, a Fast Fourier Transform (FFT) may be employed to transform or convert the steady state motor torque data. As the load 60 rolls it causes disturbances in the steady state torque. These disturbances are sinusoidal in nature due the inherent off balance of the load 60. This sinusoidal steady state torque appears in the magnitude FFT at its particular frequency, i.e. the main component. The frequency of this sinusoidal steady state torque is also the frequency, or speed, of the rotating load 60. The relationship between the rotational speed of the laundry load 60 and the rotational speed of the drum 24 can be represented mathematically by:

$$\omega_L = \omega_D\left(\frac{r_D}{r_L}\right).$$

As the load mass increases, so does its radius $r_L$; and as the radius of the load $r_L$ increases its frequency or speed $\omega_L$ decreases. At the point where the radius of the load $r_L$ is equal to that of the drum $r_D$, the frequency, or speed of the drum $\omega_D$ and the load $\omega_L$ will be equivalent. Therefore, as the load mass increases the frequency of rotation approaches, or "slides", toward that of the drum 24 explaining the results of the FFT demonstrated in FIGS. 6A-6C. In each of these figures the dotted line is used to indicate an approximate drum frequency and dash-dot-dash line is used to indicate an approximate location of the main component.

If the drum 24 is rotating at speed less than the spinning speed then the load 60 will "ball up" and rotate at an angular velocity related to that of the drum 24. This rotation of the load 60 will show up as the main component (a wide peak), in the frequency domain (using the fast Fourier Transforms i.e. FFT) as seen in FIGS. 6A-6C. This main component is the basis for the calculation of metrics $f_L$ and Δf.

The calculation of Δf is given by difference between the main component frequency and the drum frequency, or by the following equation:

$$\Delta f = \frac{\omega_L}{60} - \frac{\omega_D}{60} = \frac{\omega_L - \omega_D}{60} = f_L - f_D$$

Δf is an indication of load speed, load radius, load surface area, and load volume. Since it may be easily found in practice it may be used to for estimation of the load packing density.

There are many ways to define packing density. Some non-limiting examples are as follows:

$$PD = \frac{r_L}{r_D} = \frac{\omega_D}{\omega_L} = \frac{f_D}{f_L} = \frac{1}{\left(\frac{f_L}{f_D}\right)} = \frac{1}{f_{L_nor}}$$

Where $f_{L_nor}$ is the load frequency normalized based on the drum frequency. The higher the cloth speed is, the lower the packing density the laundry chamber is.

Alternatively, we can define the free space within the laundry chamber as:

$$F.S. = 1 - \frac{r_L}{r_D} = 1 - \frac{\omega_D}{\omega_L} = \frac{\Delta f}{f_L} = \Delta f_{nor}$$

The higher the cloth speed $\underline{f_L}$ is, the higher is frequency difference Δf and as a result, the higher is the free space F.S. within the laundry chamber.

A load size determination may be made in addition to the packing density estimation. While load density can be utilized in drying cycle to optimize mechanical action (to improve fabric care) due to tumbling. It can also be an indication of uniformity and chemistry/water coverage in cloth during dispensing process. The information about the load size combined with the packing density estimation may enable further determination of a load type, load density, number of laundry items and/or other information. Based on the combined information a specific parameter can be modified for further performance optimization, for instance, known load type may lead to a new cycle temperature set up. Load density may help in setting up the desired air flow for optimum drying time, etc.

Additionally, the load size information combined with the state of cloth fluffing detection, can be used to track cloth moisture level and therefore, determine a more accurate time of the end of the operating (in this case drying) cycle. For example, a bigger or heavier load may have more internal moisture still remaining after the state of cloth fluffing is detected, than the smaller or lighter load. Thus, the cycle for the heavier load may have a longer drying at new drying settings, than the time for the lighter load. For instance, after the state of cloth fluffing detection, a bigger load may be dried at a reduced temperature for about 5 minutes, and the smaller load may be dried at a reduced temperature for about 2-3 minutes.

The load size determination is not germane to the present invention and may be accomplished in any suitable manner. The load size may be a qualitative size, such as small, medium, or large, or a quantitative size, such as the load mass. One example of the suitable manner is to rotate the drum 24 to acquire one or more motor characteristics which may be used to derive the load size. The characteristic of the motor 44 may be any data related to the operation of the motor 44, such as motor torque, motor speed, motor current and motor voltage. The load size estimation may be provided by a user via user interface 22 or via data indicative of the load size received from one or more sensor related to the motor 44, the drum 24 or any other clothes dryer 10 components.

An initial packing density may be determined based on a parameter derived from acquired motor characteristics. The parameter may be based on a ratio of the volumes for the treating chamber 30 and the laundry 60 or may be based on a ratio of the areas for the treating chamber 30 and the laundry 60 when viewed from a plane intersecting the treating chamber 30. The motor characteristic may be acquired for any suitable time period, and an exemplary time period is time required for a complete rotation of the drum 24.

The load 60 may also be characterized by an operating range, i.e. by finding the minimum and the maximum operating speed. Once the operating range is known, a desired speed and direction of the drum 24 rotation may be determined and adjusted as needed by the controller 52, as the controller 52 is configured to set an operating parameter for the treating cycle of operation.

The minimum operating speed may be corresponding to the rolling speed, and the maximum operating may be corresponding to the spinning speed. The minimum operating speed may be found by decreasing the drum 24 speed until the frequency domain signal is changing by less than a predetermined amount. The predetermined amount may be a predetermined default, or it may be based on cycle selection, as a percentage of the determined spinning speed (or some parameter based on this), other load size/type information, and/or adaptive history. The decreasing the drum 24 speed may be done in a continuous or non-continuous manner. An exemplary range of minimum operating speeds, i.e. rolling speeds, for a drum having a 69.5 cm (27.4 in.) diameter is from about 35 to 40 rotations per minute.

The maximum operating speed may be determined by increasing the drum 24 speed and determining when random torque pulsations from tumbling are no longer observed and only steady state oscillations are present. An exemplary range of maximum operating speeds, i.e. spinning speeds, for a drum having a 69.5 cm (27.4 in.) diameter is from about 56 to 60 rotations per minute.

Figure 7:
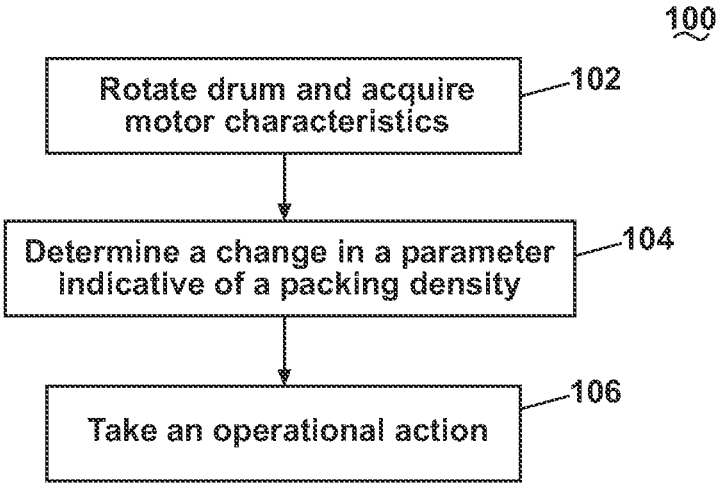
FIG. 7 a flow is chart for a method of determining load size according to a third embodiment.
Figure 8:
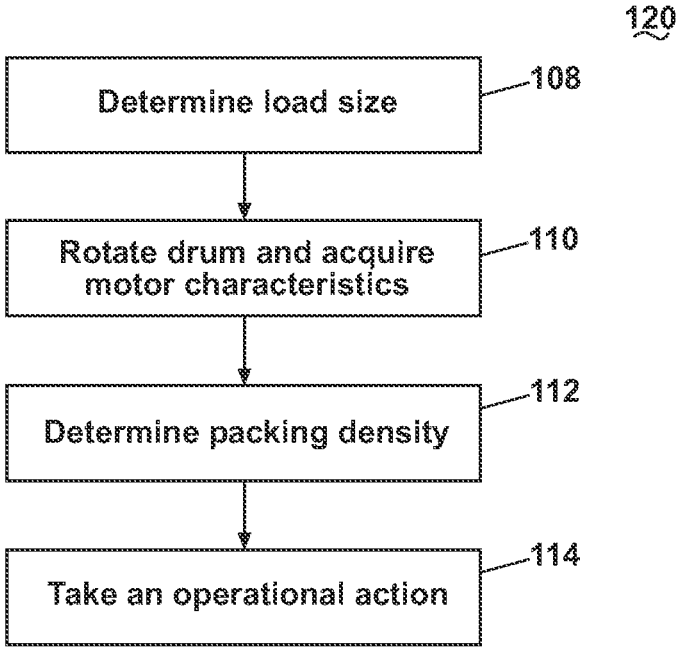
FIG. 8 a flow is chart for a method of determining load size according to a forth embodiment.

FIG. 7 is a flow chart for a method 100 of operating an appliance 10 according to a third embodiment employs the above theory for determination of packing density of the load 60. The sequence of steps depicted is for illustrative purposes only and is not meant to limit the method 100 in any way as it is understood that the steps may proceed in a different logical order, additional or intervening steps may be included, or described steps may be divided into multiple steps, without detracting from the invention. According to this embodiment, the method 100 may begin with rotating the drum and acquiring the motor characteristic at 102. The rotation of the drum and acquiring the motor characteristic of 102 may occur during any phase of the cycle of operation and for any predetermined time sufficient to acquire the motor characteristic. Determining a change in a parameter indicative of a packing density of the laundry may be performed at 104, based on the motor characteristics acquired at 102. The determination of the parameter change 104 may be done continuously or periodically and may begin by an initial packing density determination. The change in the parameter may be determined by comparing the determined parameters to a previous determination of the parameter or to a reference value. As described above, the parameter may be based on a motor torque parameter, where the motor torque parameter may be determined in one of the time domain and frequency domain, and may be a function of the tumble pattern of the laundry 60 within the treating chamber 30, such as, for example, a difference between the rotational speed of the drum 24 and the rotational speed of the laundry 60 within the treating chamber 30.

Taking an operating action based on the determined change may occur at 106. The step of the taking an operating action may be a selection of at least a phase of operation for a cycle, such as for example, an untwisting or untangling cycle. Alternatively, or additionally, the taking an operating action 106 may be to in a form of setting an operating parameter for the cycle of operation. The operating parameter may be selected from at least one of: a speed of rotation for the drum 24, direction of rotation for the drum 24, air flow rate through the drum 24, temperature of air flow through the drum 24, an end of a cycle phase flag, and an end of cycle of operation flag.

The taking an operating action 106 may also be determining a state of cloth fluffing, followed by determining an operating parameter for a remaining part of the cycle of operation. The operating parameter for the remaining part of the cycle of operation may be selected from at least one of: a speed of rotation for the drum, a direction of rotation for the drum, an air flow rate through the drum, a temperature of air flow through the drum, estimated time of an end of phase of the cycle and estimated time of an end of the cycle.

The method 100 may be a stand alone cycle of operation or it may be run as part of or contemporaneously with a cycle of operation. The information obtained from the determined packing density or the change in packing density over time may then be used by the controller to take an action on the operation of the appliance. The operational action taken can be multiple actions and may include statically or dynamically setting a system parameter or setting a cycle parameter. The setting of a cycle parameter may include altering cycle parameters, such as speed, direction and duration of the drum rotation. It may also include the termination of one or more steps or phases of the cycle of operation, including the complete termination of the cycle of operation.

The method 120 according to the fourth embodiment of the present invention, similar to the method described above, may begin with a 108 of determining a laundry load size. As described above, the laundry load size may be provided by a user via the 22 user interface or may be automatically determined by the dryer. Similarly, as the method 100 described above, the rotation of the drum and acquiring the motor characteristic 110 may occur during any phase of the cycle of operation and for any predetermined time sufficient to acquire the motor characteristic. Alternatively, the load size determination 108 may occur during the drum rotation at 110. Based on the acquired motor characteristics, the packing density may be determined at 112. The determination may be made based on a parameter indicative of the packing density and may be done continuously or periodically.

Taking an operating action based on the determined change may occur at 114. The step of the taking an operating action may be a selection of at least a phase of operation for a cycle, such as for example, an untwisting or untangling phase. Alternatively, or additionally, the taking an operating action 114 may be to in a form of setting an operating parameter for the cycle of operation. The operating parameter may be selected from at least one of: a speed of rotation for the drum 24, direction of rotation for the drum 24, air flow rate through the drum 24, temperature of air flow through the drum 24, an end of a cycle phase flag, and an end of cycle of operation flag.

The taking an operating action 114 may also be determining a state of cloth fluffing, followed by determining an operating parameter for a remaining part of the cycle of operation. The operating parameter for the remaining part of the cycle of operation may be selected from at least one of: a speed of rotation for the drum, a direction of rotation for the drum, an air flow rate through the drum, a temperature of air flow through the drum, estimated time of an end of phase of the cycle and estimated time of an end of the cycle.

The method 100 has been described with respect to the clothes dryer 10 in FIG. 1; however, the method 100 may be adapted for use with other types of laundry treating appliances, including horizontal axis washing machines having a tilted drum and vertical axis washing machines.

Packing density provides an estimate of the volume of the laundry load and can provide information on the tumble pattern. Thus, the information about packing density may be used as a parameter for the mechanical action component in a horizontal-axis washer and an estimate of the packing density can provide the basis for a routine to enhance cleaning and prevention of fabric damage. The embodiments provide an automatic packing density determination that employs existing components of the laundry treating appliance; the motor functions not only to rotate the drum but also works as a sensor that provides data for use in determining the laundry load size, thereby eliminating the cost of additional sensors and the like.

In a dryer application, the packing density estimation can enable an algorithm for tumble pattern optimization through both motor speed and rotational direction resulting in robustness to load size, load type, tangling, and water removal variation. In addition, packing density can provide an estimate of the available surface area of the load to estimate water or chemistry volumes needed for wrinkle removal, odor removal, softness, whitening, brightening or the addition of fragrance. Other types of laundry treating appliances may also benefit from the present invention by employing an untwisting or untangling cycle. Therefore, the determination and monitoring of the packing density during the cycle of operation or any phase of the cycle may improve the overall performance of a laundry treating appliance.

While the invention has been specifically described in connection with certain specific embodiments thereof, it is to be understood that this is by way of illustration and not of limitation, and the scope of the appended claims should be construed as broadly as the prior art will permit.

What is claimed is:

1. A laundry treating appliance for treating laundry according to a treating cycle of operation, comprising:

a rotatable drum defining a treating chamber in which laundry is received and treated according to the treating cycle of operation;

a motor operably coupled to the drum to effect a rotation of the drum and generating a motor torque signal;

at least one component operably coupled to the treating chamber for carrying out the treating cycle of operation; and a controller operably coupled to the motor to receive the motor torque signal and to the at least one component, and where the controller is configured to control the motor and the at least one component to execute the treating cycle of operation, and where the controller is configured to determine a packing density or a change in the packing density of the laundry during the execution of the treating cycle of operation based upon the motor torque signal in a frequency domain, and where the controller is configured to alter an execution of the treating cycle of operation based upon the determined packing density or change in the packing density.

2. The laundry treating appliance of claim 1 wherein the at least one component comprises at least one of:

an air flow system for supplying air to the treating chamber;

a heating system for heating air in the treating chamber; and a chemistry dispersing system for supplying chemistry to the treating chamber.

3. The laundry treating appliance of claim 2 wherein the controller is configured to implement at least one of an untwisting cycle and an untangling cycle as part of the execution of the treating cycle of operation.

4. The laundry treating appliance of claim 2 wherein the controller is configured to set an operating parameter for the treating cycle of operation.

5. The laundry treating appliance of claim 4 wherein the operating parameter for the treating cycle of operation comprises at least one of:

a speed of rotation for the drum;

a direction of rotation for the drum;

an air flow rate through the drum;

a temperature of air flow through the drum; and an end of cycle flag.

6. The laundry treating appliance of claim 1 wherein the controller is configured to determine a state of cloth fluffing.

7. The laundry treating appliance of claim 6 wherein the controller is further configured to set an operating parameter for a remaining part of the treating cycle of operation.

8. The laundry treating appliance of claim 7 wherein, the operating parameter comprises at least one of:

a speed of rotation for the drum;

a direction of rotation for the drum;

an air flow rate through the drum;

a temperature of air flow through the drum;

estimated time of an end of phase of the treating cycle of operation; and estimated time of an end of the treating cycle of operation.

* * * * *